US010709927B1

(12) United States Patent
Smith, Jr.

(10) Patent No.: US 10,709,927 B1
(45) Date of Patent: Jul. 14, 2020

(54) MULTI-POSITION HORIZONTAL ELLIPTICAL CYCLE FITNESS EQUIPMENT

(71) Applicant: Alfred Sidney Smith, Jr., Sammish, WA (US)

(72) Inventor: Alfred Sidney Smith, Jr., Sammish, WA (US)

( * ) Notice: Subject to any disclaimer, the term of this patent is extended or adjusted under 35 U.S.C. 154(b) by 28 days.

(21) Appl. No.: 16/174,850

(22) Filed: Oct. 30, 2018

(51) Int. Cl.

| | |
|---|---|
| ***A63B 22/06*** | (2006.01) |
| ***A63B 22/00*** | (2006.01) |
| ***A63B 21/22*** | (2006.01) |
| ***A63B 21/00*** | (2006.01) |

(52) U.S. Cl.
CPC ..... *A63B 22/0664* (2013.01); *A63B 21/225* (2013.01); *A63B 21/4034* (2015.10); *A63B 21/4035* (2015.10); *A63B 22/001* (2013.01); *A63B 2022/067* (2013.01); *A63B 2225/09* (2013.01)

(58) Field of Classification Search
CPC ..... A63B 22/0664; A63B 21/225; A63B 21/4035; A63B 21/4034; A63B 22/001; A63B 2225/09; A63B 2022/067
See application file for complete search history.

(56) References Cited

U.S. PATENT DOCUMENTS 3,709,487 A 1/1973 Walker
5,163,339 A * 11/1992 Giard, Jr. ..... B62K 21/125 403/374.4
5,226,866 A * 7/1993 Engel ..... A63B 21/015 482/52
5,235,872 A * 8/1993 Giard, Jr. ..... B62K 21/125 248/118
5,320,591 A 6/1994 Harmon
5,704,856 A 1/1998 Morse
5,938,570 A * 8/1999 Maresh ..... A63B 22/001 482/57
6,146,313 A * 11/2000 Whan-Tong ..... A63B 22/001 482/51
6,238,324 B1 5/2001 MacMillan
(Continued)

OTHER PUBLICATIONS

"Back2Crawl Prfessional Series Bear Crawl Horizontal Exercise Machine, Black" as downloaded from the Internet on Oct. 29, 2018 from "https://www.houzz.com/product/63267353-back2crawl-professional-series-bear-crawl-horizontal-exercise-machine-black-contemporary-home-gym-equipment".

*Primary Examiner* — Andrew S Lo
(74) *Attorney, Agent, or Firm* — QuickPatents, LLC; Kevin Prince

(57) ABSTRACT

An exercise apparatus includes two side frames each having a base member and a front member projecting upward from the base member. Each side frame is aligned and mutually fixed together at a rear cross member, a forward cross member, and a top cross member. A crank mechanism has two cranks and is fixed with the rear cross member. Two foot members each have a foot base member with a foot pad, and a foot front member projecting upward from the foot base member and pivotally fixed with the top cross member. Each foot member is also pivotally fixed at a rear side thereof with one of the cranks. In use, with the person resting a foot in each of the foot pads, the person performs elliptical-type exercise by raising and lowering his feet, holding onto the top cross member or handles for support as desired.

8 Claims, 5 Drawing Sheets

(56) References Cited

U.S. PATENT DOCUMENTS 6,482,130 B1* 11/2002 Pasero ..... A63B 22/001 482/51
7,137,937 B2 11/2006 Croft
7,455,628 B1* 11/2008 Stearns ..... A63B 22/001 482/52
7,608,019 B1* 10/2009 Stearns ..... A63B 22/001 482/52
7,611,450 B2 11/2009 Mancini
7,682,288 B1* 3/2010 Stearns ..... A63B 22/0664 482/51
7,946,970 B2 5/2011 Garza
8,062,195 B2 11/2011 Israeli
8,303,473 B2 11/2012 Gutierrez
8,801,580 B1* 8/2014 Maresh ..... A63B 22/001 482/52
8,864,631 B1* 10/2014 Stearns ..... A63B 22/0664 482/51
9,339,685 B1* 5/2016 Maresh ..... A63B 22/04
9,764,187 B1* 9/2017 Stearns ..... A63B 21/023
10,315,068 B1* 6/2019 Stearns ..... A63B 21/023
2002/0151411 A1* 10/2002 Stearns ..... A63B 22/001 482/52
2005/0130814 A1 6/2005 Nitta
2006/0223679 A1* 10/2006 Gerschefske ..... A63B 21/023 482/52
2007/0015633 A1* 1/2007 Gerschefske ..... A63B 22/001 482/52
2007/0039409 A1* 2/2007 Meng ..... B62K 21/12 74/551.8
2009/0247371 A1* 10/2009 Dey ..... A63B 22/0007 482/52
2010/0093499 A1* 4/2010 Ohrt ..... A63B 23/03591 482/52
2010/0199801 A1* 8/2010 Huang ..... B62K 21/12 74/551.3
2011/0092348 A1 4/2011 McBride
2011/0136628 A1* 6/2011 Stearns ..... A63B 22/001 482/52
2011/0281690 A1* 11/2011 Van Straaten ..... A63B 21/015 482/52
2012/0053013 A1* 3/2012 Maresh ..... A63B 21/0051 482/4
2012/0272777 A1* 11/2012 Tolhurst ..... B62K 21/125 74/491
2014/0024508 A1 1/2014 Hinds
2015/0057129 A1* 2/2015 Lo ..... A63B 22/0664 482/52
2015/0352402 A1* 12/2015 Arnold ..... A63B 23/03591 482/57
2017/0028247 A1* 2/2017 Arnold ..... A63B 22/0015
2018/0111019 A1* 4/2018 Ellis ..... A63B 21/068

* cited by examiner

MULTI-POSITION HORIZONTAL ELLIPTICAL CYCLE FITNESS EQUIPMENT

CROSS-REFERENCE TO RELATED APPLICATIONS

This application claims the benefit of US Design Patent Application 29/662,937, filed on 10 Sep. 2018, and incorporated herein by reference.

STATEMENT REGARDING FEDERALLY SPONSORED RESEARCH AND DEVELOPMENT

Not Applicable.

FIELD OF THE INVENTION

This invention relates to exercise devices, and more particularly to a multi-position horizontal elliptical exercise cycle.

DISCUSSION OF RELATED ART

Elliptical-type exercise machines are well known and popular. However, prior art elliptical-type exercise machines have the drawback that they keep the exercising person in an upright position, which fails to exercise certain of the person's chest, triceps, back and shoulder muscles, and can result in a routine and somewhat boring workout.

Therefore, there is a need for a device that allows the person to perform elliptical-type exercises while in a more prone position, such as when riding a bicycle. Such a needed invention would also allow the person to perform the elliptical-type exercises while in an upright position but further require the person to maintain his balance during such exercise. Further, such a needed invention would provide for a number of different handle supports so that the person could perform the exercises in a number of different ways. The present invention accomplishes these objectives.

SUMMARY OF THE INVENTION

The present device is an exercise apparatus for a person to exercise on a support surface, such as a floor. Two side frames each include a base member and a front member projecting upward from a front side of the base member. Each side frame is aligned and mutually fixed together at a rear cross member, a forward cross member, and a top cross member. Preferably each member is formed with a perforated square metal tube material which has a plurality of longitudinally-aligned equally-spaced apertures formed along each side thereof.

A crank mechanism has two cranks and is fixed with the rear cross member. The cranks may be independent of each other or rotationally fixed together. Preferably the crank mechanism is supported on a rear base fixed at a forward end thereof with the rear cross member and at a rear end with a second rear cross member.

Two foot members are included that each have a foot base member with a foot pad on a top side thereof, and a foot front member projecting upward from a front side of the foot base member. Each foot member is pivotally fixed at a top side of the foot front member with the top cross member. Each foot member is also pivotally fixed at a rear side of the foot base member with one of the cranks of the crank mechanism. Preferably each foot pad includes an angled wedge fixed therewith for assisting the person in standing in the foot pad on the ball of his foot. Each foot pad is preferably adjustably and selectively fixed with the apertures of the foot base member. Likewise, the cranks are preferably selectively fixed with the apertures of the rear side of the foot base members.

In use, with the person resting a foot in each of the foot pads, the person can perform elliptical-type exercise by raising and lowering his feet, holding onto the top cross member for support as desired.

In some embodiments each foot front member further includes a handle projecting upwardly therefrom above the top cross member, the handles each being adapted for grasping by the person. These handles move with the foot front member while the person performs the exercises. Alternately, or additionally, a central handle may be pivotally fixed with the top cross member and adapted for grasping by the person at a comfortable angle, depending on the stature of the person and the exercise being performed. Such a central handle may further include at least one arm pad for supporting at least one of the person's arms while the person grasps the central handle. The person may also stand on the foot pads while moving the foot members, without holding onto any of the handles, or the top cross member, thereby requiring additional balance by the person during such an exercise.

The present invention is an exercise device that allows the person to perform elliptical-type exercises while in a more prone position, such as when riding a bicycle. The present device also allows the person to perform the elliptical-type exercises while in an upright position but further require requires the person to maintain his balance during such exercise. Further, the present invention provides for a number of different handle supports so that the person could perform the exercises in a number of different ways. Other features and advantages of the present invention will become apparent from the following more detailed description, taken in conjunction with the accompanying drawings, which illustrate, by way of example, the principles of the invention.

DETAILED DESCRIPTION OF THE PREFERRED EMBODIMENT

Illustrative embodiments of the invention are described below. The following explanation provides specific details for a thorough understanding of and enabling description for these embodiments. One skilled in the art will understand that the invention may be practiced without such details. In other instances, well-known structures and functions have not been shown or described in detail to avoid unnecessarily obscuring the description of the embodiments.

Unless the context clearly requires otherwise, throughout the description and the claims, the words "comprise," "comprising," and the like are to be construed in an inclusive sense as opposed to an exclusive or exhaustive sense; that is to say, in the sense of "including, but not limited to." Words using the singular or plural number also include the plural or singular number respectively. Additionally, the words "herein," "above," "below" and words of similar import, when used in this application, shall refer to this application as a whole and not to any particular portions of this application. When the claims use the word "or" in reference to a list of two or more items, that word covers all of the following interpretations of the word: any of the items in the list, all of the items in the list and any combination of the items in the list. When the word "each" is used to refer to an element that was previously introduced as being at least one in number, the word "each" does not necessarily imply a plurality of the elements, but can also mean a singular element.

Figure 1:
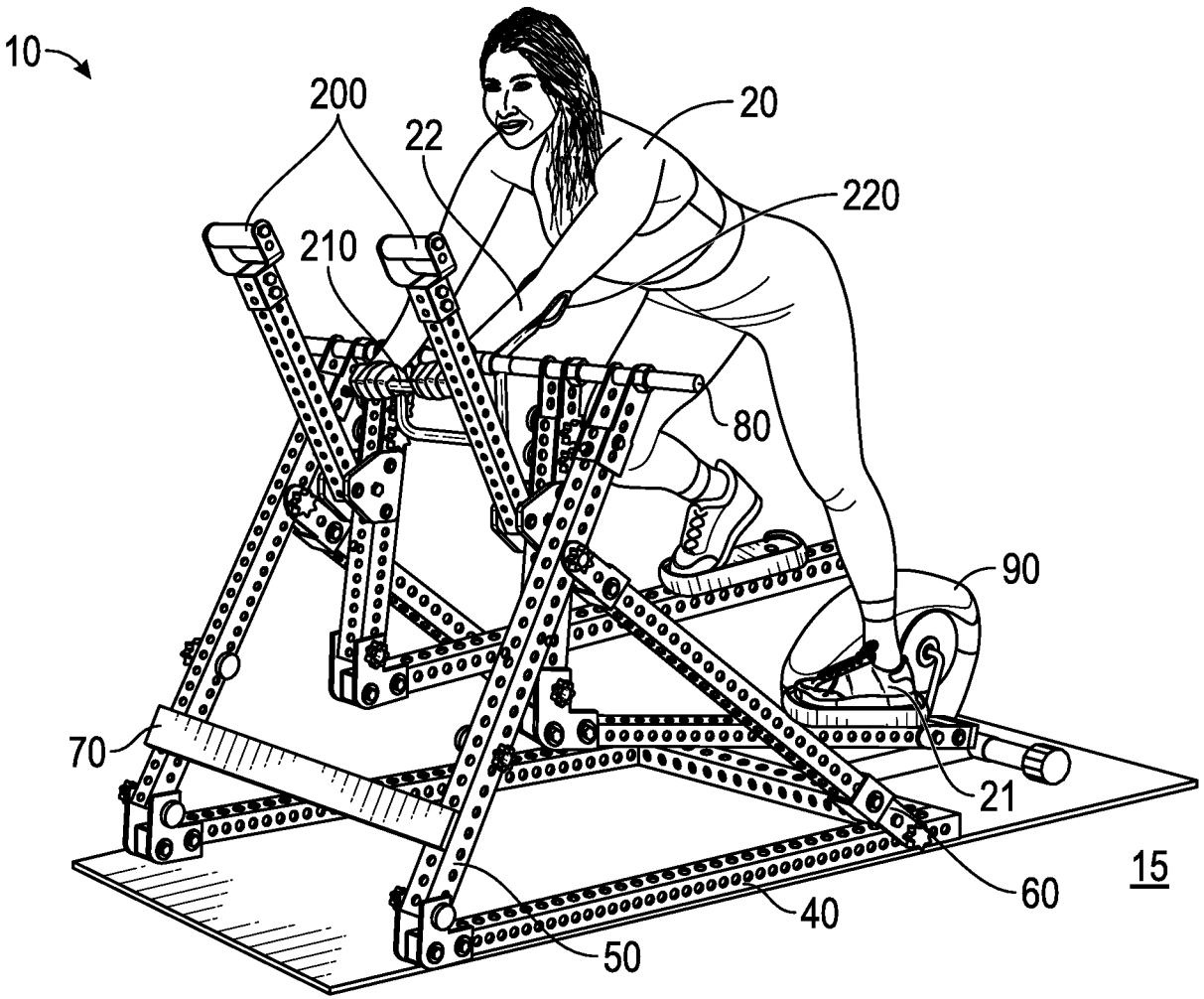
FIG. 1 is a perspective view of the exercise device of the present invention, illustrated with a person grasping a central handle.
Figure 4:
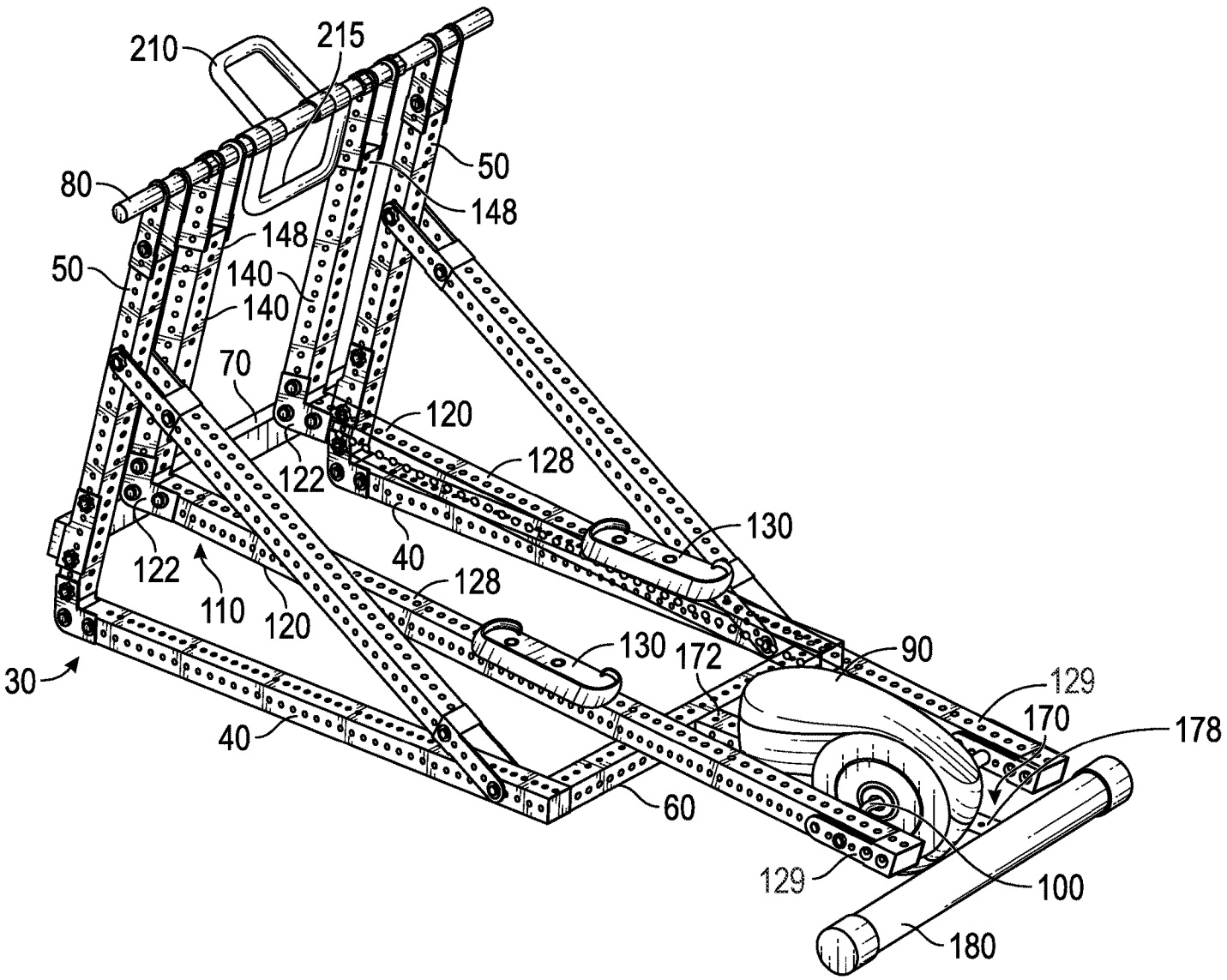
FIG. 4 is a top perspective view of the invention.

FIG. 1 illustrates an exercise apparatus 10 for a person 20 to exercise on a support surface 15, such as a floor. Two side frames 30 each include a base member 40 and a front member 50 projecting upward from a front side 42 of the base member 40. Each side frame 30 is aligned and mutually fixed together at a rear cross member 60, a forward cross member 70, and a top cross member 80 (FIG. 4). In some embodiments, the side frames 30 each include an angled support member 160 fixed at an angle between the base member 40 and the front member 50.

Preferably each member 40,50,60,70,80,110,120,140 is formed with a perforated square metal tube material 150 (FIG. 5), which has a plurality of longitudinally-aligned equally-spaced apertures 156 formed along each side 155 thereof. Such a tube material 150 is preferably made from rigid steel or other suitably strong material.

Figure 5:
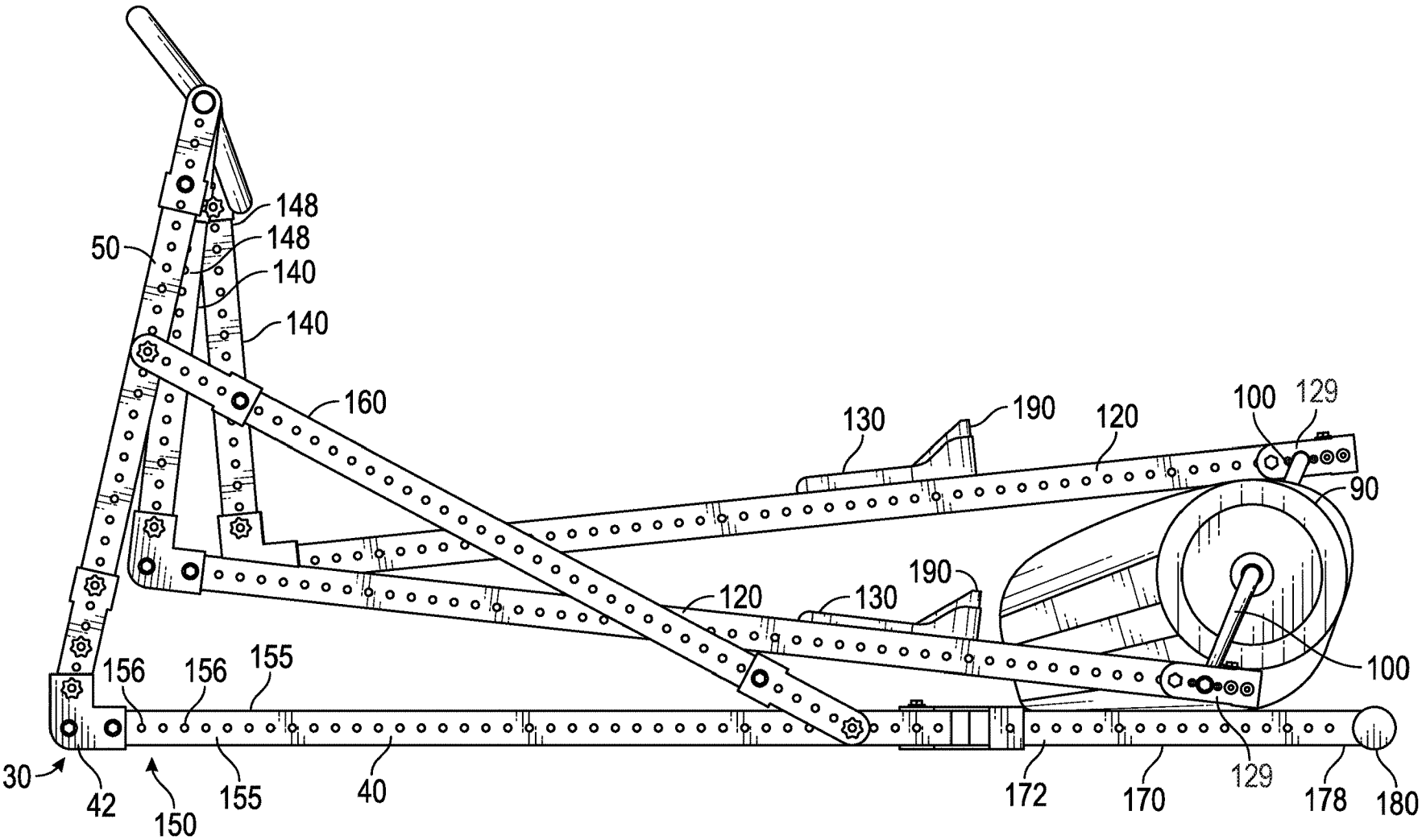
FIG. 5 is a side elevational view of the invention.

A crank mechanism 90 has two cranks 100 and is fixed with the rear cross member 60. Such a crank mechanism 90, as is known in the art, comprises a flywheel having pedals or cranks 100 that drive the flywheel rotationally. The flywheel can further include a resistance adjustment mechanism, such as a friction pad resting against the flywheel, for increasing or decreasing the resistance of the flywheel to rotation by the cranks 100. The cranks 100 may be independent of each other or rotationally fixed together, such as those cranksets manufactured by PowerCranks (www.powercranks.com), Full Speed Ahead (www.fullspeedahead.com), Praxis Works (https://praxiscycles.com/cranks/), and the like, and preferably include a ratcheting mechanism for allowing the cranks to be stilled while the flywheel continues to spin. Preferably the crank mechanism 90 is supported on a rear base 170 fixed at a forward end 172 thereof with the rear cross member 60 and at a rear end 178 with a second rear cross member 180 (FIGS. 4 and 5).

Two foot members 110 are included that each have a foot base member 120 with a foot pad 130 on a top side 128 thereof, and a foot front member 140 projecting upward from a front side 122 of the foot base member 120. Each foot member 110 is pivotally fixed at a top side 148 of the foot front member 140 with the top cross member 70. Each foot member 110 is also pivotally fixed at a rear side 129 of the foot base member 120 with one of the cranks 100 of the crank mechanism 90. Preferably each foot pad 130 includes an angled wedge 190 fixed therewith for assisting the person 20 in standing in the foot pad 130 on the ball of his foot 21. Each foot pad 130 is preferably adjustably and selectively fixed with the apertures 156 of the foot base member 120. Likewise, the cranks 100 are preferably selectively fixed with the apertures 156 of the rear side 129 of the foot base members 120.

In use, with the person 20 resting a foot 21 in each of the foot pads 130, the person 20 can perform elliptical-type exercise by raising and lowering his feet 21, holding onto the top cross member 80 for support as desired.

Figure 2:
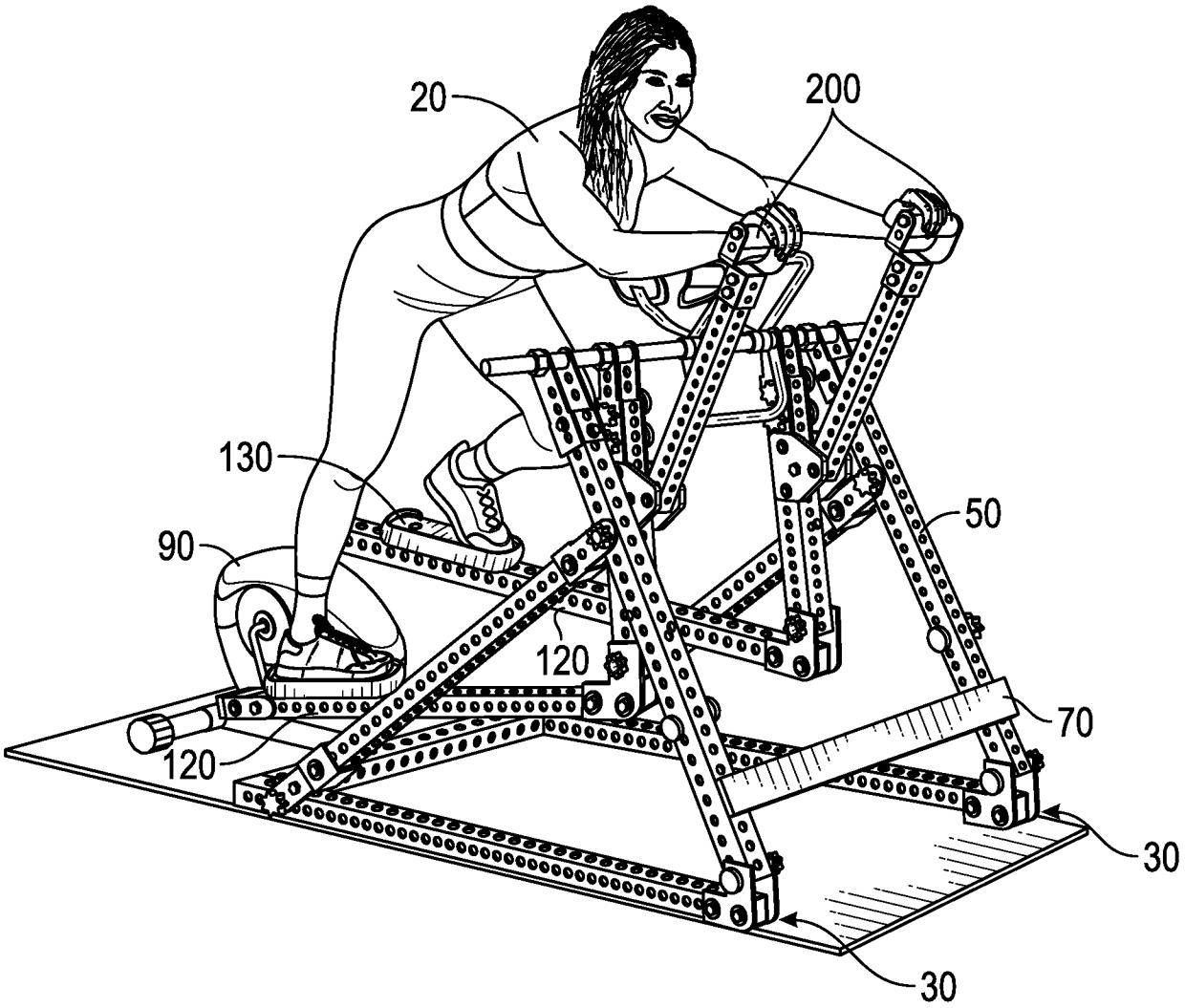
FIG. 2 is an alternate perspective view of the invention, illustrated with the person grasping a handle fixed with one of two foot front members.
Figure 3:
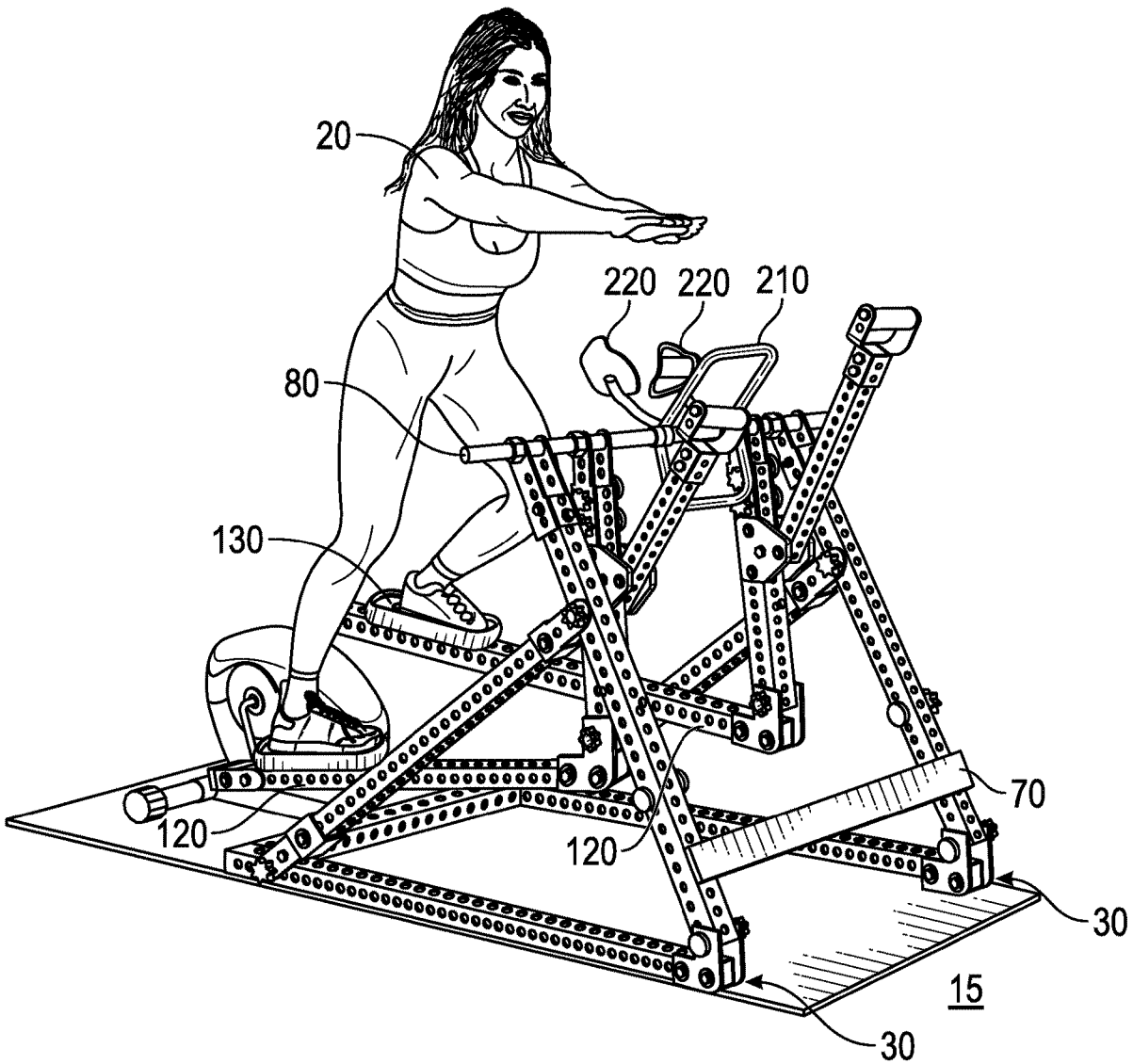
FIG. 3 is an alternate perspective view of the invention, illustrated with a person balancing on the exercise device.

In some embodiments each foot front member 140 further includes a handle 200 (FIG. 2) projecting upwardly therefrom above the top cross member 80, the handles 200 each being adapted for grasping by the person 20. These handles 200 move with the foot front member 140 while the person 20 performs the exercises. Alternately, or additionally, a central handle 210 (FIG. 1) may be pivotally fixed with the top cross member 80 and adapted for grasping by the person 20 at a comfortable angle, depending on the stature of the person 20 and the exercise being performed. Such a central handle 210 may further include at least one arm pad 220 for supporting at least one of the person's arms 22 while the person grasps the central handle 210. The person 20 may also stand on the foot pads 130 while moving the foot members 110, without holding onto any of the handles 200,210 or the top cross member 80, thereby requiring additional balance by the person 20 during such an exercise.

While a particular form of the invention has been illustrated and described, it will be apparent that various modifications can be made without departing from the spirit and scope of the invention. For example, other types of handles or supports may be added to the exercise device 10. Accordingly, it is not intended that the invention be limited, except as by the appended claims.

Particular terminology used when describing certain features or aspects of the invention should not be taken to imply that the terminology is being redefined herein to be restricted to any specific characteristics, features, or aspects of the invention with which that terminology is associated. In general, the terms used in the following claims should not be construed to limit the invention to the specific embodiments disclosed in the specification, unless the above Detailed Description section explicitly defines such terms. Accordingly, the actual scope of the invention encompasses not only the disclosed embodiments, but also all equivalent ways of practicing or implementing the invention.

The above detailed description of the embodiments of the invention is not intended to be exhaustive or to limit the invention to the precise form disclosed above or to the particular field of usage mentioned in this disclosure. While specific embodiments of, and examples for, the invention are described above for illustrative purposes, various equivalent modifications are possible within the scope of the invention, as those skilled in the relevant art will recognize. Also, the teachings of the invention provided herein can be applied to other systems, not necessarily the system described above. The elements and acts of the various embodiments described above can be combined to provide further embodiments.

All of the above patents and applications and other references, including any that may be listed in accompanying filing papers, are incorporated herein by reference. Aspects of the invention can be modified, if necessary, to employ the systems, functions, and concepts of the various references described above to provide yet further embodiments of the invention.

Changes can be made to the invention in light of the above "Detailed Description." While the above description details certain embodiments of the invention and describes the best mode contemplated, no matter how detailed the above appears in text, the invention can be practiced in many ways. Therefore, implementation details may vary considerably while still being encompassed by the invention disclosed herein. As noted above, particular terminology used when describing certain features or aspects of the invention should not be taken to imply that the terminology is being redefined herein to be restricted to any specific characteristics, features, or aspects of the invention with which that terminology is associated.

While certain aspects of the invention are presented below in certain claim forms, the inventor contemplates the various aspects of the invention in any number of claim forms. Accordingly, the inventor reserves the right to add additional claims after filing the application to pursue such additional claim forms for other aspects of the invention.

What is claimed is:

1. An exercise apparatus for a person to exercise on a support surface, comprising:

two side frames each including a base member and a front member projecting upward from a front side of the base member, each side frame aligned and mutually fixed together at a rear cross member, a forward cross member, and a top cross member;

a crank mechanism having two cranks and fixed with the rear cross member; and two foot members each having a foot base member with a foot pad on a top side thereof, and a foot front member projecting upward from a front side of the foot base member, each foot member pivotally fixed at a top side of the foot front member with the top cross member and pivotally fixed at a rear side of the foot base member with one of the cranks of the crank mechanism;

wherein each member of the side frames and the foot members is formed with a perforated square metal tube material having a plurality of longitudinally-aligned equally-spaced apertures formed along each side thereof;

whereby when a person rests a foot in each of the foot pads of one of the foot members, the person can perform elliptical exercises by raising and lowering his feet, holding onto the top cross member for support as desired.

2. The exercise apparatus of claim 1 wherein the side frames each further include an angled support member fixed at an angle between the base member and the front member of the side frames.

3. The exercise apparatus of claim 1 wherein the crank mechanism is supported on a rear base fixed at a forward end with the rear cross member and at a rear end with a second rear cross member.

4. The exercise apparatus of claim 1 wherein each foot pad further includes an angled wedge fixed therewith for assisting the person in standing in the foot pad on the ball of his feet.

5. The exercise apparatus of claim 1 wherein each foot front member further includes a handle projecting upwardly therefrom above the top cross member and adapted for grasping by the person.

6. The exercise apparatus of claim 1 further including a central handle pivotally fixed with the top cross member and adapted for grasping by the person.

7. The exercise apparatus of claim 6 wherein the central handle further includes at least one arm pad for supporting at least one of the person's arms while the person grasps the central handle.

8. The exercise apparatus of claim 1 wherein each foot pad is adjustably, selectively fixed with the apertures of the foot member.

* * * * *